US006648381B2

(12) United States Patent
Holton et al.

(10) Patent No.: US 6,648,381 B2
(45) Date of Patent: Nov. 18, 2003

(54) TRUNK TIE-DOWN

(76) Inventors: Charles J. Holton, 16801 Peacock Rd., Haslett, MI (US) 48840; James E. Bartek, 3830 - 56th St., Grandville, MI (US) 49418

( * ) Notice: Subject to any disclaimer, the term of this patent is extended or adjusted under 35 U.S.C. 154(b) by 0 days.

(21) Appl. No.: 09/884,627

(22) Filed: Jun. 19, 2001

(65) Prior Publication Data

US 2002/0190531 A1 Dec. 19, 2002

(51) Int. Cl.[7] ..... E05C 19/18
(52) U.S. Cl. ..... 292/288; 292/262; 24/298
(58) Field of Search ..... 24/298, 300, 301, 24/302, 599.4, 599.6, 599.7, 599.8, 265 H, 905; 292/288, 299, DIG. 16, DIG. 42, DIG. 43, 262

(56) References Cited

U.S. PATENT DOCUMENTS

| | | | | | |
|---|---|---|---|---|---|
| 429,779 | A | * | 6/1890 | Shelby | |
| 4,191,413 | A | * | 3/1980 | Barner | 292/262 |
| 4,569,108 | A | * | 2/1986 | Schwab | 24/17 R |
| 4,653,422 | A | * | 3/1987 | Allen | 116/28 R |
| 4,666,194 | A | * | 5/1987 | Charman | 292/288 |
| 4,667,993 | A | * | 5/1987 | Hannesson et al. | 292/339 |
| 4,860,408 | A | * | 8/1989 | Johnson | 24/68 CD |
| 5,187,844 | A | * | 2/1993 | Simond | 24/599.5 |
| 5,297,828 | A | * | 3/1994 | Chung | 292/258 |
| 5,647,619 | A | * | 7/1997 | DeLisio | 292/288 |
| 5,915,631 | A | * | 6/1999 | Laxton et al. | 24/302 |
| 6,029,941 | A | | 2/2000 | Mayzes | |
| 6,038,745 | A | * | 3/2000 | Rapp | 24/68 R |

* cited by examiner

*Primary Examiner*—Gary Estremsky

(57) ABSTRACT

A trunk tie-down has a catch that releasably couples with a strike of a vehicle lock mechanism, and a latch connected with the catch, that releasably couples with an opposing catch of the vehicle lock mechanism. The latch may have a first latch portion and an opposing second latch portion, each being generally U-shaped with a bight and a pair of legs. The legs of the first and the second latch portions extend toward each other and are coupled together. The bight of the first latch portion may also lie in a first reference plane while the bight of the second latch portion lies in a second reference plane. The first and the second reference planes may be perpendicular. Each of the first and the second latch portion bights may have a dimension of thickness with the second latch portion bight being thicker than the first latch portion bight. The latch may be connected with the catch so that the latch is oriented with one of the first and the second latch portions positioned toward the catch and the latch extending generally away from the catch to the other of the second and first the latch portions. The tie-down may also include an elongated member interposed between and interconnecting the latch and the catch. Alternatively, the tie-down may have a first tie end and an opposing second tie, a catch, and a latch connected with the catch. The catch may have an aperture that extends through the catch along a line. The catch may be located at the first tie end. The latch may have a generally U-shaped portion with a bight and a pair of legs. The U-shaped portion may define a reference plane that is preferably not perpendicular to and is most preferably parallel with the line. The latch may be at the second tie end.

18 Claims, 11 Drawing Sheets

TRUNK TIE-DOWN

CROSS-REFERENCES TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

The invention relates to tie-downs and in particular to a tie-down that engages the opposing catch and latch of a vehicle trunk lid, for example.

People commonly use cars and other vehicles to transport items that are too large to fit within the vehicle. Thin cords or even string is frequently used to tie a load of oversized items to vehicles. Probably most common is a situation where an oversized item is placed in a car trunk. In such a case, the trunk lock cannot be latched and the trunk must be left open. This may include the back door of the so called hatch back vehicles, as well as the single back door of many mini-vans, for example. The options at this point are generally limited.

One may merely let the trunk lid bounce against the load as the wind of driving forces the lid downward and bumps in the roadway jounce the lid upward. This may damage both the load and the vehicle. The load may also bounce out of the trunk.

Alternatively, one may attempt to tie the trunk lid down against the load with a cord or the like. Many vehicles do not provide convenient tying points for this purpose, however. Also, if a place to tie a cord can be found, it often will have a metal edge that will likely chafe and cut a cord and especially a string.

Too often, the typical make shift attempts at transporting oversized items fail and the load is accidentally unloaded, this is, spilled over the roadway. The potential for accident, damage to property, and harm to persons is real and readily apparent. Thus, a need for safely securing oversize loads does exist and is not adequately addressed.

BRIEF SUMMARY OF THE INVENTION

Accordingly, a trunk tie-down of the invention has a catch that releasably couples with a strike of a vehicle lock mechanism, and a latch connected with the catch, that releasably couples with an opposing catch of the vehicle lock mechanism. The latch may have a first latch portion and an opposing second latch portion, each being generally U-shaped with a bight and a pair of legs. The legs of the first and the second latch portions extend toward and are connected with each other.

In further aspects of the invention, the bight of the first latch portion may lie in a first reference plane while the bight of the second latch portion may lie in a second reference plane. The first and the second reference planes are most preferably perpendicular.

Each of the first and the second latch portion bights may have a dimension of thickness with the second latch portion bight being thicker than the first latch portion bight. The latch may be connected with the catch so that the latch is oriented with one of the latch portions positioned toward the catch and the latch extending generally away from the catch to the other latch portion. The tie-down may also include an elongated member interposed between and interconnecting the latch and the catch. The elongated member may be length adjustable.

In other aspects of the invention, the tie-down may have a first tie end and an opposing second tie, a catch, and a latch connected with the catch. The catch may have an aperture that extends through the catch along a line. The catch may be located at the first tie end. The latch may have a generally U-shaped portion with a bight and a pair of legs. The U-shaped portion may define a reference plane that is preferably not perpendicular to and is most preferably parallel with the line. The latch may be at the second tie end.

These and other features, objects, and benefits of the invention will be recognized by one having ordinary skill in the art and by those who practice the invention, from the specification, the claims, and the drawing figures.

DETAILED DESCRIPTION OF THE INVENTION

Figure 1:
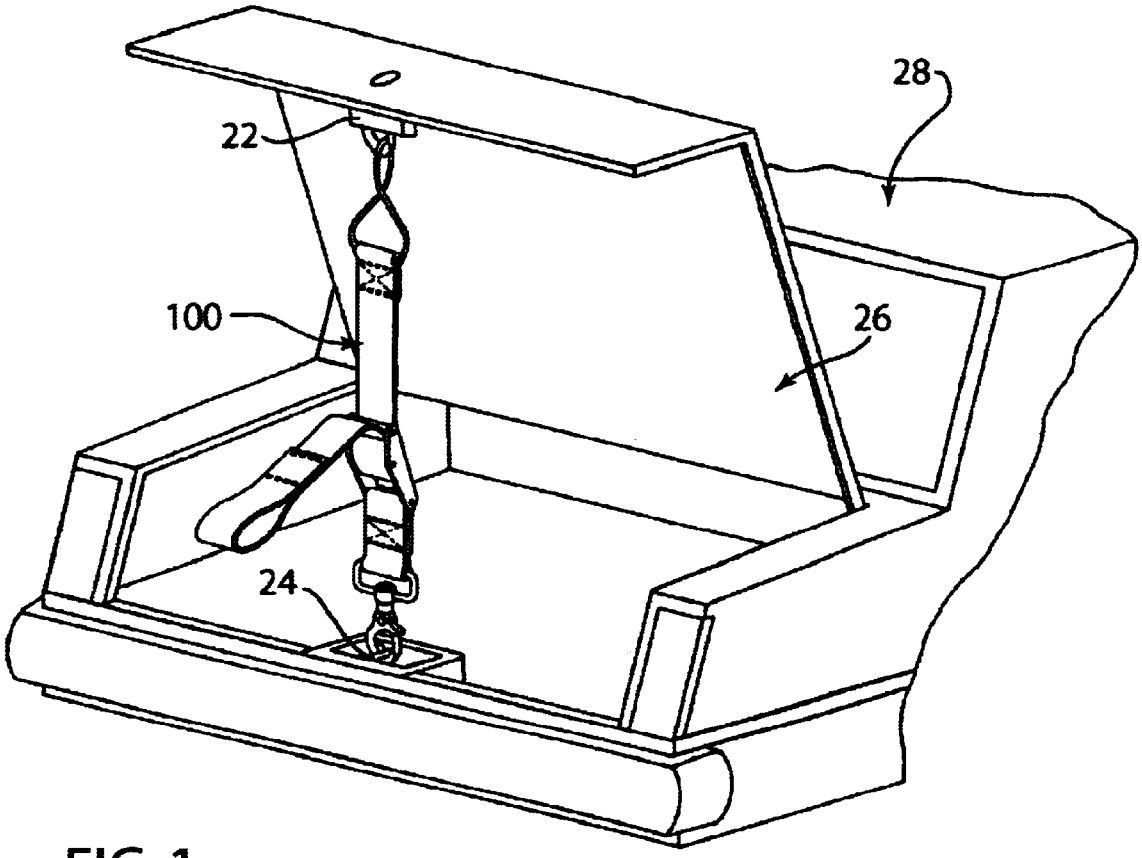
FIG. 1 is a fragmentary perspective view of a trunk tie-down of the invention coupled between the catch and latch of a trunk lock in use.

Preferred embodiments of a trunk tie-down according to the invention are generally shown in the drawing figures and discussed below. A trunk tie-down first embodiment 100 of the invention is shown in position between the opposing catch 22 and latch 24 of an open trunk 26 of a car 28 or the like (FIG. 1). More particularly, the tie-down 100 has a catch 122 that is connected with a latch 124. Preferably, the catch 122 and latch 124 are interconnected with an adjustment strap 126.

Figure 2:
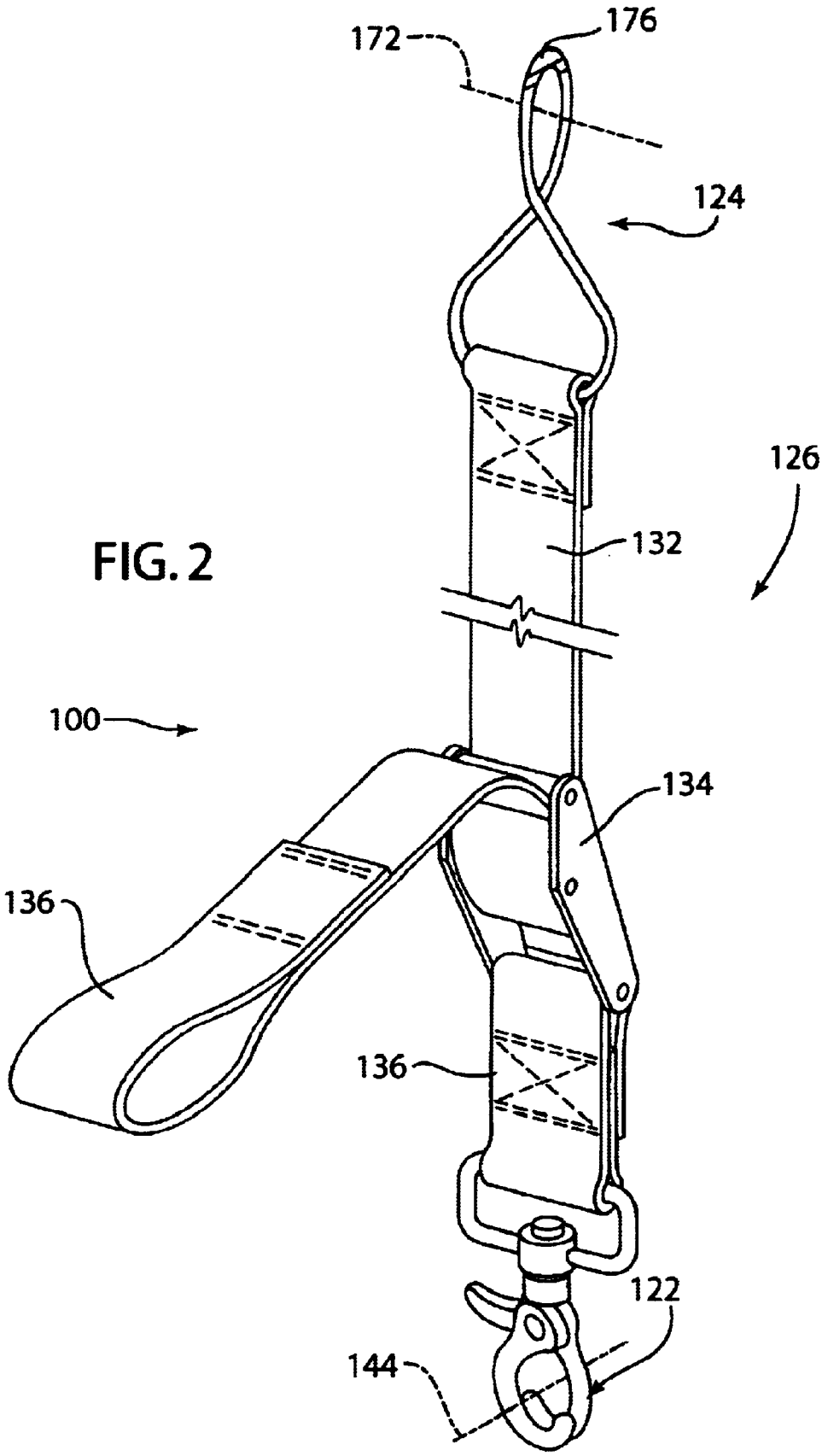
FIG. 2 is front perspective view of the tie-down.
Figure 3:
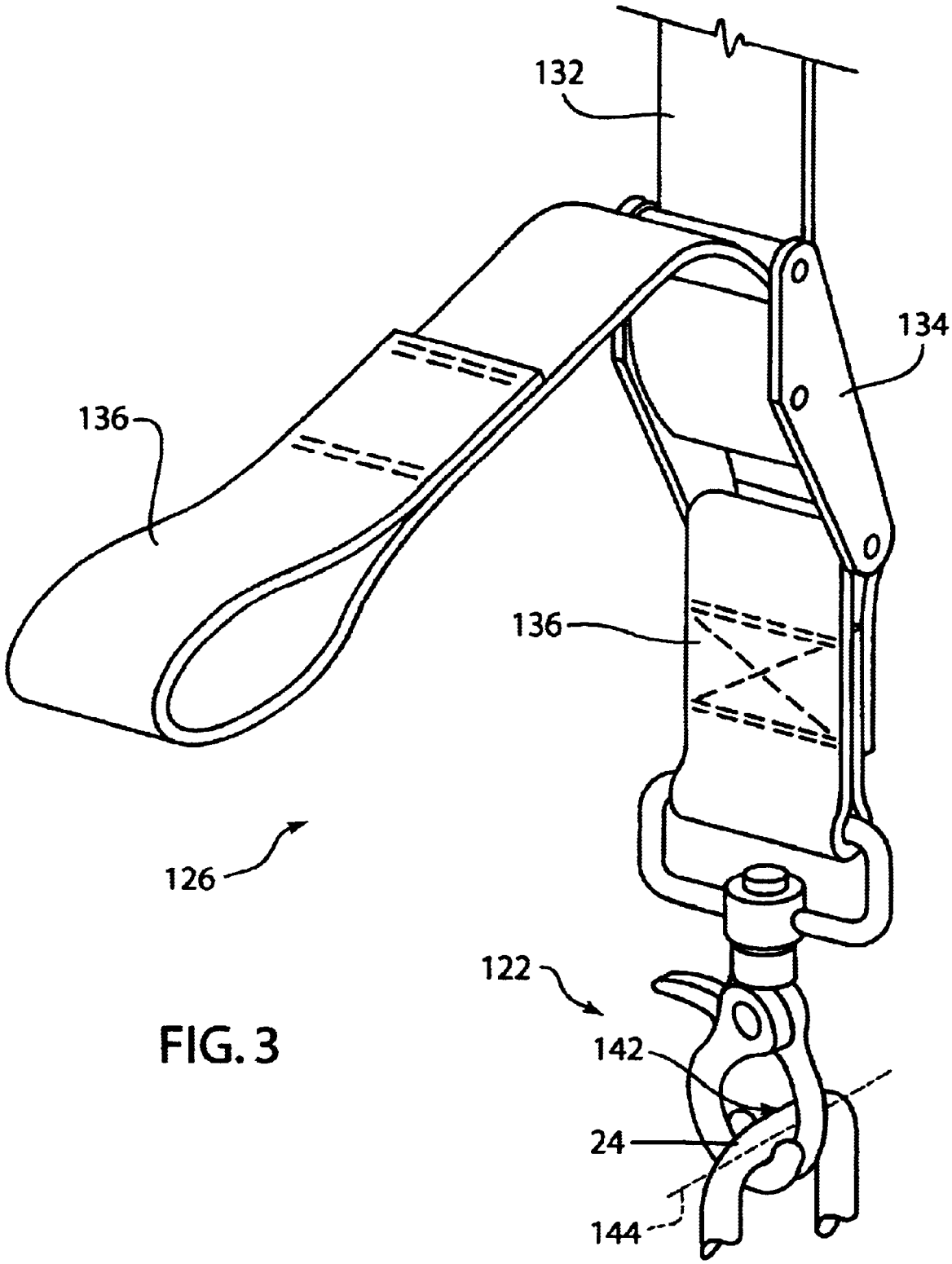
FIG. 3 is a fragmentary enlarged perspective view thereof, showing a catch and adjustment buckle.

The adjustment strap 126 may be an elongated member that is preferably length adjustable and may include a first piece of web strap 132 that is coupled with the latch 124, a buckle 134 that is coupled with the trap 132, and a second piece of web strap 136 that is coupled between the buckle 134 and the catch 122 (FIGS. 2 and 3). The web strap 132 and 136 may be an about one to one and a half inch (25 to 38 mm) fabric web strap as is commonly known. The buckle 134 may be a common spring loaded cam buckle that is sized to match the strap as shown. Of course, the particular material and construction of either the strap 132 or the buckle 134 may vary according to the requirements of a user or manufacturer. For example, a cord may substitute for the strap 132 and the strap or cord may be made to conduct an electric current or not, also a variety of length adjustment device may be substituted for the buckle 134, including without limitation, a double ring arrangement, as is well known. The strap 132 may be provided with a grasping loop 138, which facilitates cinching the tie-down snug, as shown.

The catch 122 may be any suitable clasp or hook, preferably with a keeper. The catch 122 preferably defines an aperture 142 that extends through the catch along a line 144 (FIG. 3). A common snap hook, as shown, has been found to work well. A clasp or hook with a keeper is preferred so a user may releasably capture the strike or latch 24 of a trunk in the catch 122, and more particularly in the aperture 142. The trunk strike 24 is preferably captured in the aperture 142 until intentionally released, so the tie-down 100 will not merely fall from or otherwise disengage the vehicle strike 24.

Figure 4:
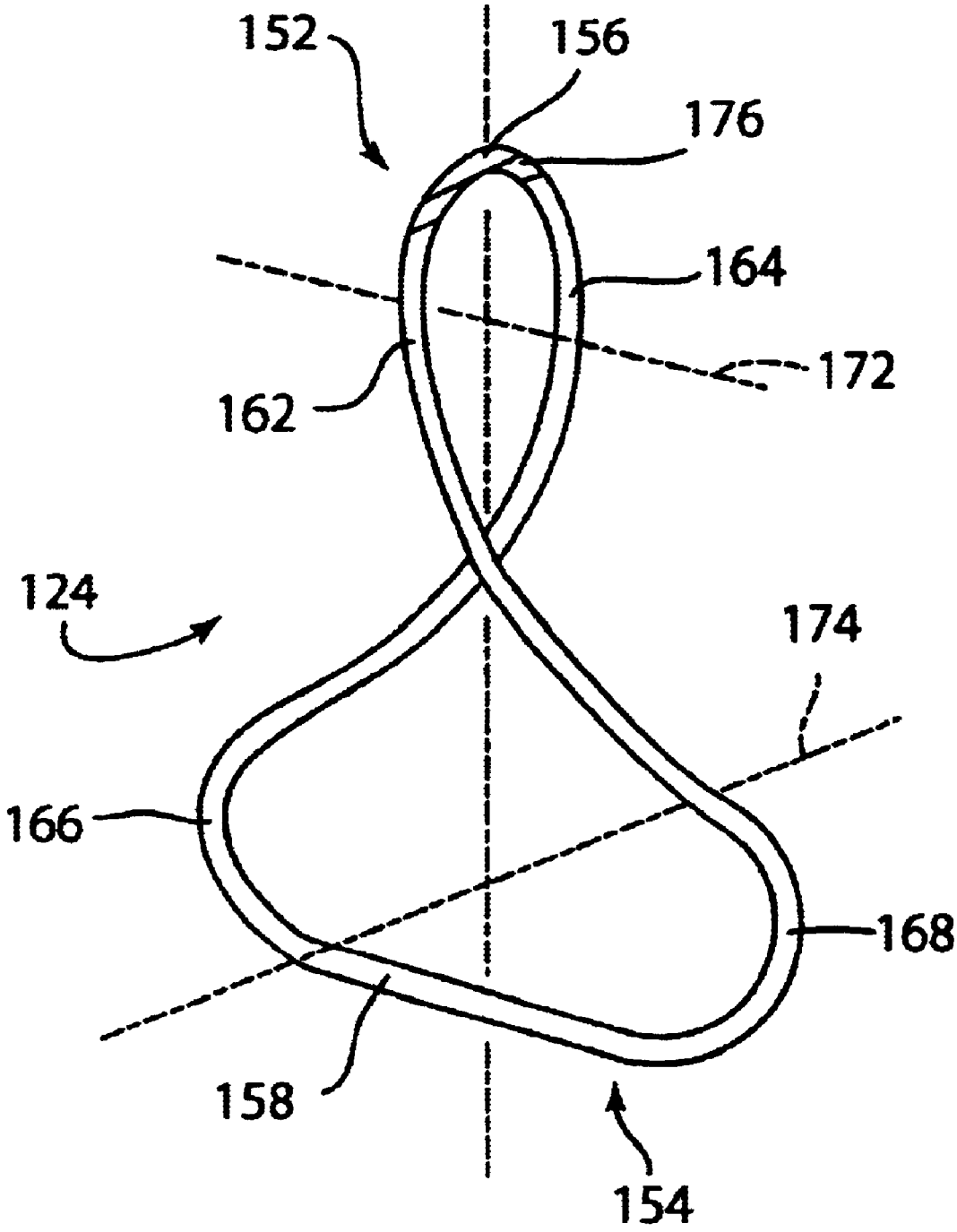
FIG. 4 is a front perspective view of a first latch thereof.

The latch 124 is substantially an elongated annular member. The latch has first and second latch portions 152 and 154, respectively, that are each generally U-shaped with a bight 156 and 158, respectively, and a pair of legs 162–168, respectively (FIG. 4). Each of the first and the second latch portions 152 and 154, respectively, generally defines a reference plane. This is illustrated in drawing FIG. 4 by the use of normal lines 172 and 174, respectively. Thus, normal line 172 extends perpendicular to the first latch portion 152, while normal line 174 extends perpendicular to the second latch portion 154. Further, the first and second latch portions 152 and 154, respectively, are most preferably perpendicular to one another. It is further noted that the normal line 172 is also most preferably perpendicular to the line 144 of the catch 122.

A more elementary concept of the latch 124 is that it may be a twisted oval. Regardless, the latch 124 is preferably formed with a given clearance between the legs 162–168, so the strap 126 may be slipped from the second bight 154 to the first bight 152, or visa versa.

While the catch 122 is adapted to capture the strike 24 of a trunk lock, for example, the latch 124 is adapted to be captured in the trunk lock catch 22. Thus, at least some of the dimensions of the latch 124 are dictated by function with the trunk catches of various vehicle manufacturers. While some exemplary dimensions are provided below, one having ordinary skill in the art will understand that the dimensions given are exemplary and that alternative dimensions may be substituted without departing from the invention or the spirit of the disclosed concept. Thus, the latch 124 is preferably formed from a length of about three sixteenths inch (4.7 mm) wire or the like. The wire is looped into an annular member and ends of the wire are most preferably welded or otherwise fastened to maximize the strength of the latch 124. The inventors have found that an overall length of the annular member of roughly about four and three quarters inches (121 mm) and a width of roughly about one and three eighths inches (35 mm) provides a latch 124 that falls easily to hand and is confidently manipulated by a user. For similar reason, the two latch portions 152 and 154 may be proportioned relative to the overall length of the latch 124, in the range of about one-to-one to about three-to-one.

Figure 5:
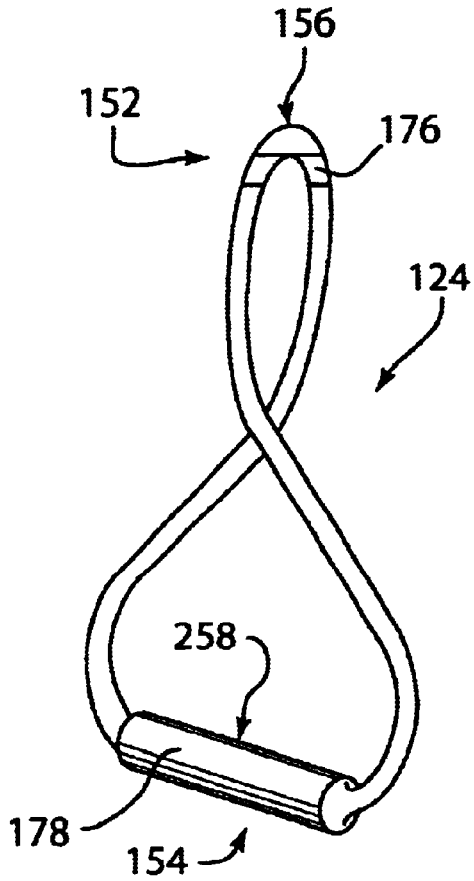
FIG. 5 is the view of FIG. 4 showing a thickened bight portion thereof.

While dimensioning the wire diameter at about three sixteenths inch (4.7 mm) will accommodate a great number of current vehicle trunk locks and the like, more vehicles are accommodated when at least a segment 176 the first latch portion 152 is struck or the like to a thickness of about one eighth inch (3.2 mm). Even more vehicles are accommodated when at least a segment 178 of the second latch portion 154 is enlarged to a diameter of about seven sixteenths inches (11 mm) (FIG. 5). The segment 178 may be made relatively thicker by various constructions, including and not limited to the use of an overlaying sleeve, which may be fixed or removable.

In use, the catch 122 is opened and clasped over the vehicle strike 24, which releasably couples the catch 122 with the vehicle strike 24. The latch 124 is inserted into the vehicle catch 22 and captured by the vehicle catch in place of the vehicle latch 24. One having ordinary skill in the art will understand that convenience of using the tie-down 100 is enhanced by having the catch 122 capture the vehicle strike 24 and not be left to fall free from the strike. As discussed above, a relative distance between the catch 122 and the latch 124 may vary when in use as a trunk lid may bounce against an over size load as the wind of driving forces the lid downward and as bumps in the roadway jounce the lid. Thus, one having ordinary skill in the art will understand the desirability of having both of the tie-down catch 122 and latch 124 being securely engaged with the corresponding vehicle latch 24 and catch 22 for various reasons, including and not limited to safety issues and property damage issues.

Depending upon the requirements of the vehicle catch 22, the latch 124 is positioned with one of the two latch portions 152 and 154 positioned at the strap 132 and the other of the two latch portions 152 and 154 extending away from the strap 132. If an opposing orientation of the latch 124 is desired, the strap 132 is slid along the latch 124 to the other latch portion 152 or 154. Once oriented as desired, the end of the latch 124 that extends away from the strap 132 is pressed into the vehicle catch 22 in locking engagement.

With both of the catch 12 and the latch 124 engaging their respective vehicle counterparts, namely the strike 24 and catch 22, the end or loop 136 of the strap 126 may be pulled and the tie-down snugged. Release of the tie-down is merely a matter of actuating the vehicle lock, whereby the latch 124 is released from the trunk lock catch 22. The tie-down catch 122 is removed from the vehicle latch 124 by merely reversing the engaging process. Lengthening the strap 126 is provided by manipulation of the buckle 134, as one having ordinary skill in the art will understand.

Figure 6:
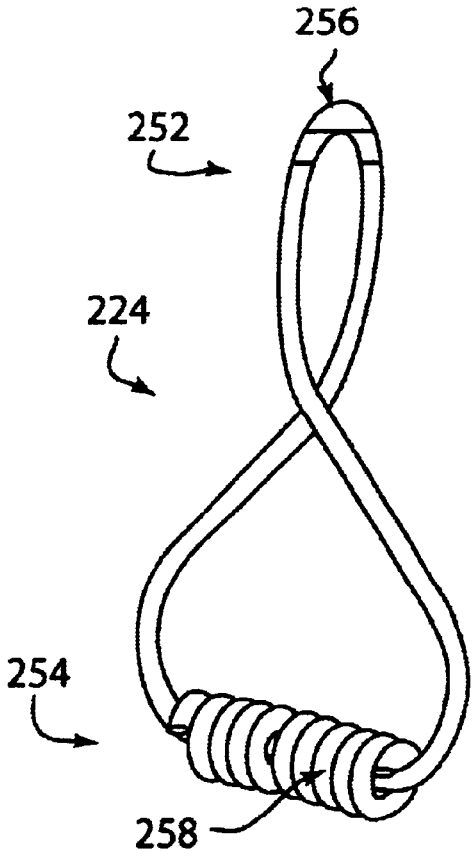
FIG. 6 is a front perspective view of a second latch.

A first alternative latch 224 (FIGS. 5 and 6) is substantially the same as the first latch 124. The second latch 224 is also a twisted annular member and has bights 256 and 258 of latch portions 252 and 254, respectively. The latch 224 differs in that the thickened bight 258 is formed by wrapping ends of a wire that is used to fabricate the latch 224.

Figure 7:
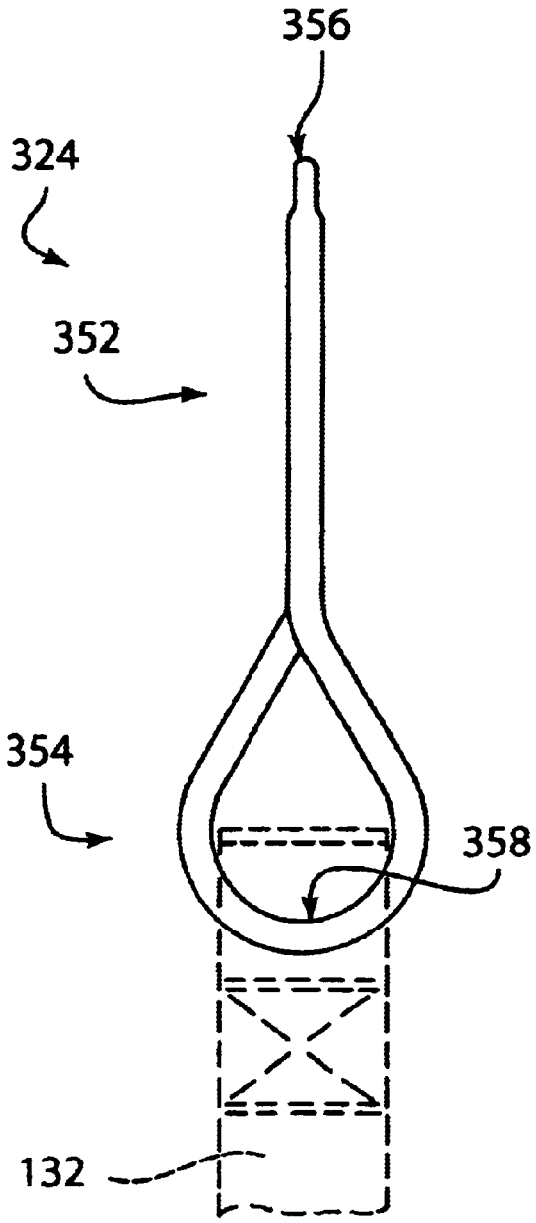
FIG. 7 is a front elevational view of a third latch with a connecting strap shown in phantom fragment, the opposing back elevational view being substantially the same.
Figure 8:
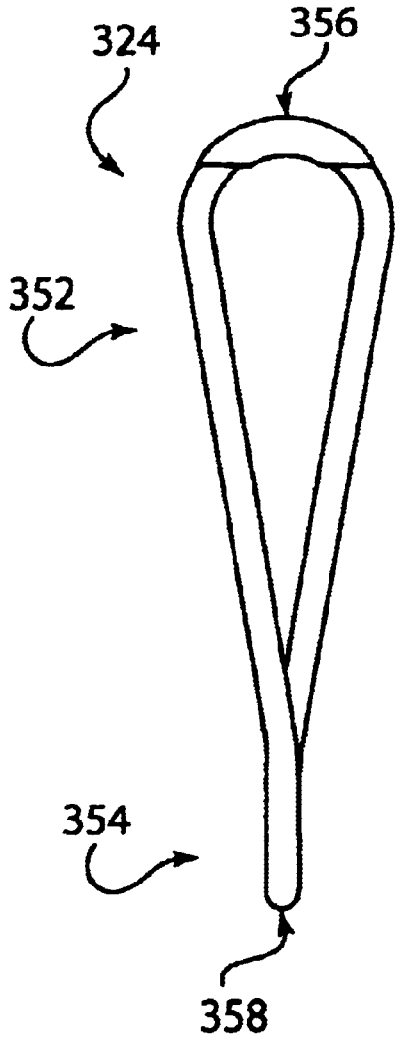
FIG. 8 is a side elevational view thereof, the opposing side elevational view being substantially the same.

A second alternative latch 324 (FIGS. 7 and 8) is substantially similar to the first latch 124. The third latch 324 is a twisted annular member with latch portions 352 and 354 and bights 356 and 358, respectively.

Figure 9:
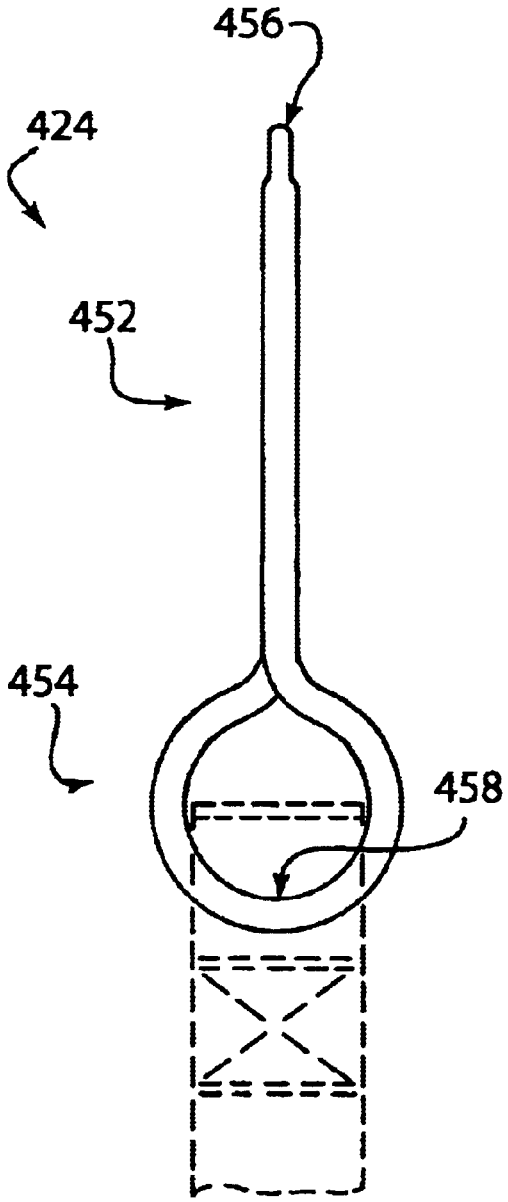
FIG. 9 is a front elevational view of a fourth latch with a connecting strap shown in phantom fragment, the opposing back elevational view being substantially the same.
Figure 10:
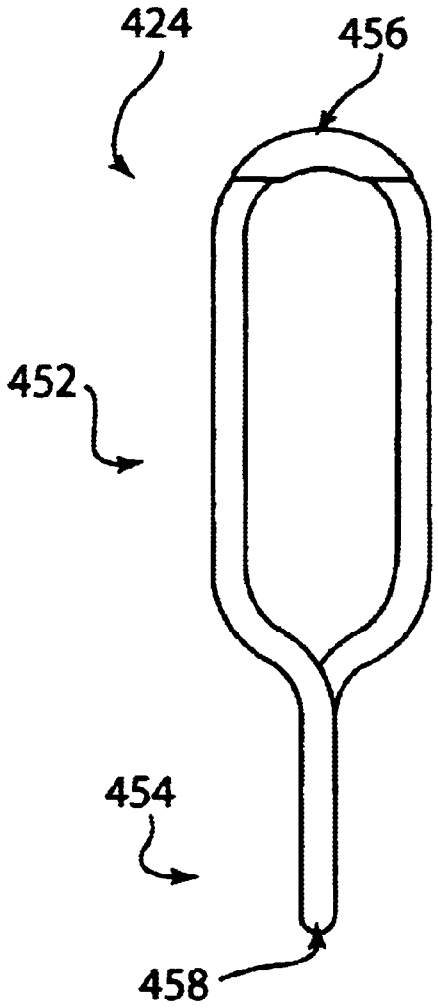
FIG. 10 is a side elevational view thereof, the opposing side elevational view being substantially the same.

A third alternative latch 424 (FIGS. 9 and 10) is also substantially similar to the first latch 124. The fourth latch 424 is a twisted annular member with bights 456 and 458 of latch portions 452 and 454, respectively.

Figure 11:
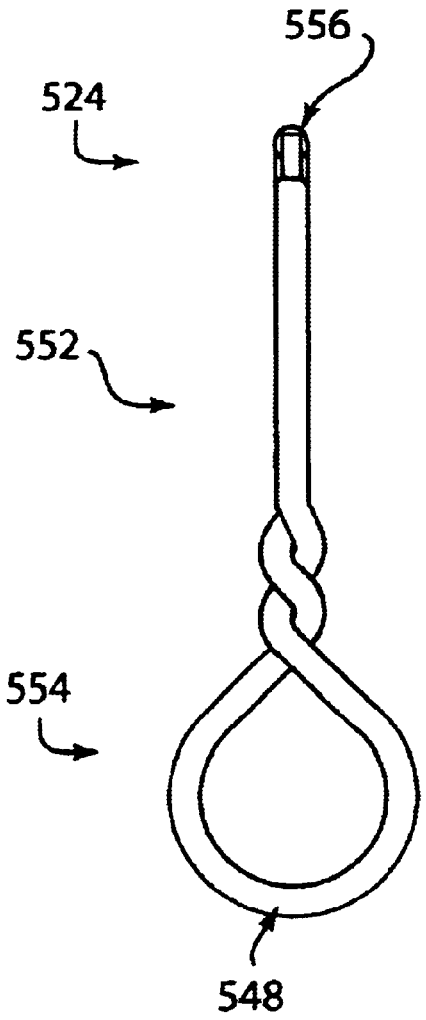
FIG. 11 is a front elevational view of a fifth latch with a connecting strap shown in phantom fragment, the opposing back elevational view being substantially the same.
Figure 12:
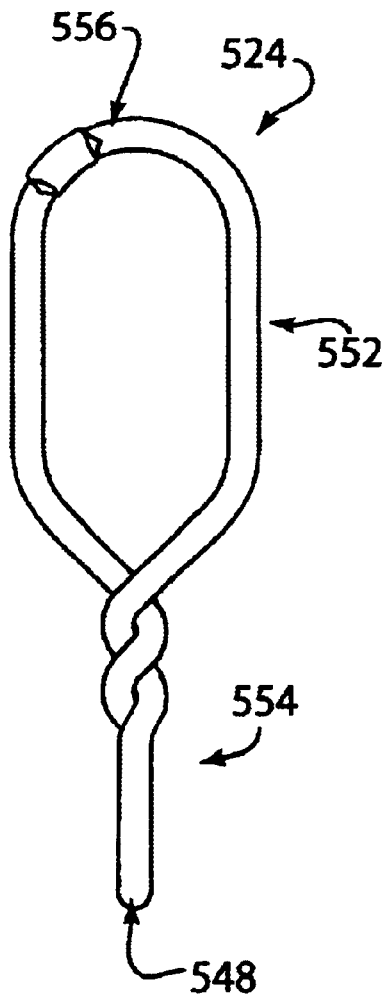
FIG. 12 is a side elevational view thereof, the opposing side elevational view being substantially the same.

A fourth alternative latch 524 (FIGS. 11 and 12) is similar to the first latch 124. The fifth latch 524 is also a twisted annular member with bights 556 and 558 of latch portions 552 and 554, respectively. The latch 524 is twisted to the point of wrapping together the legs of the latch portions 552 and 554, however. Thus, the strap will not slide between the two latch portions 552 and 554, respectively. Versatility of the latch 524 may be enhanced with a removable over laying sleeve, as discussed above, that is positioned at the bight 556.

Figure 13:
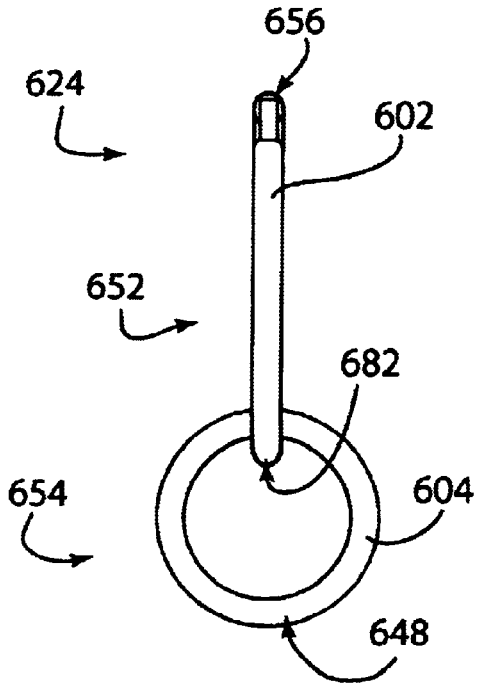
FIG. 13 is a front elevational view of a sixth latch with a connecting strap shown in phantom fragment, the opposing back elevational view being substantially the same.
Figure 14:
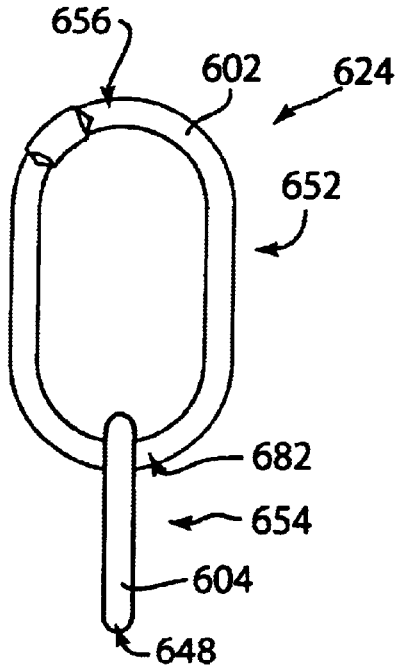
FIG. 14 is a side elevational view thereof, the opposing side elevational view being substantially the same.

A fifth alternative latch 624 (FIGS. 13 and 14) is similar to the first latch 124. The sixth latch 624 is a pair of annular members 602 and 604 with bights 656 and 658 of latch portions 652 and 654, respectively. The annular members 602 and 604 are noted to define distinct reference planes. The annular members 602 and 604 may be oriented generally perpendicular to one another. Utility of the latch 624 with a great number of differing vehicle locks may be enhanced by thickening a bight 682 with a thicker material or with an over laying sleeve, as discussed above.

Figure 15:
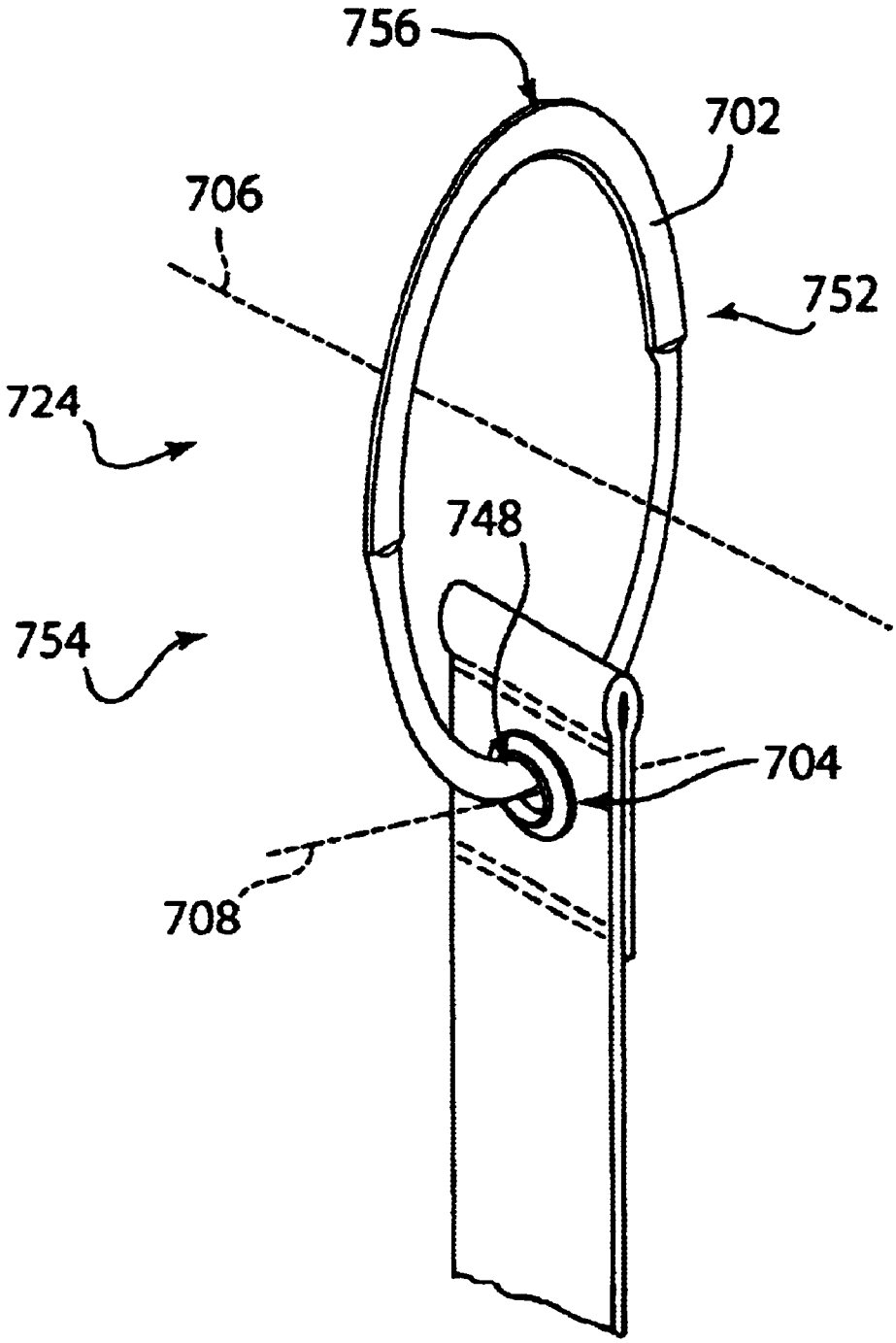
FIG. 15 is a perspective view of a seventh latch with a connecting strap shown in fragment.

A sixth alternative latch 724 (FIG. 15) is similar to the sixth latch 624. The seventh latch 724 has a pair of annular members 702 and 704. The annular members 702 and 704 are noted to define distinct reference planes with normal lines 706 and 708, respectively. The annular members 702 and 704 may be oriented generally perpendicular to one another. The annular member 702 includes bights 756 and 758 of latch portions 752 and 754, respectively. Utility of the latch 724 with a great number of differing vehicle locks may be enhanced by thickening a bight 748 with a thicker material or with an over laying sleeve, as discussed above.

Figure 16:
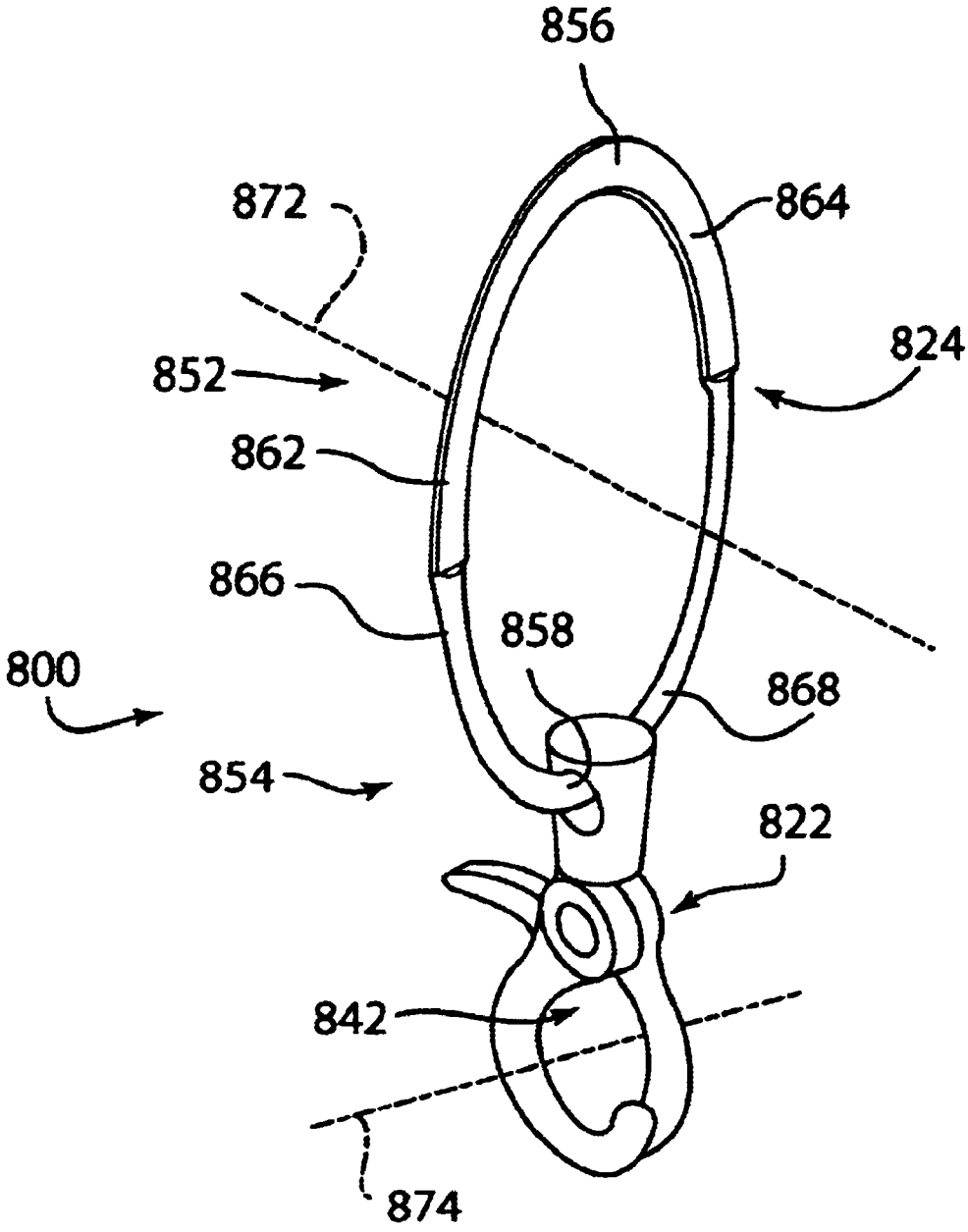
FIG. 16 is a perspective view of an alternative embodiment of a tie-down of the invention

A first alternative tie-down 800 has an annular member or latch 824 connected with a catch 822 (FIG. 16). The latch 824 also has first and second latch portions 852 and 854, respectively. Each latch portion 85 and 854 includes a bight 856 and 858 and a pair of legs 862–868. At least one of the latch portions 852 and 854 defines a first reference plane with a normal line 872. The catch 822 may be substantially similar to the catch 122 discussed above. Thus, the catch 822 also defines an aperture that extends through the catch along a line 874. It is noted that the lines 872 and 874 are generally askew and most preferably lie in perpendicular planes. Utility of the tie-down 800 with a great number of differing vehicle locks may be enhanced by thickening the bight 858 with a thicker material or with an over laying sleeve, as discussed above.

It will be understood by one having ordinary skill in the art and by those who practice the invention, that various modifications and improvements may be made without departing from the spirit of the disclosed concept. Various relational terms, including left, right, front, back, top, and bottom, for example, are used in the detailed description of the invention and in the claims only to convey relative positioning of various elements of the claimed invention. The scope of protection afforded is to be determined by the claims and by the breadth of interpretation allowed by law.

I claim:

1. A tie-down comprising:

a catch, the catch being adapted to releasably couple with a strike of a vehicle lock mechanism;

a latch connected with the catch, the latch having a first latch portion and an opposing second latch portion, the first latch portion being generally U-shaped with a first bight and a first pair of legs the first bight extending in a first direction from one of the first pair of legs to the other of the first pair of legs, the second latch portion being generally U-shaped with a second bight and a second pair of legs, the second bight extending in a second direction from one of the second pair of legs to the other of the second pair of legs, the first and the second directions being generally perpendicular relative to one another, one of the first pair of legs extending toward and being connected with one of the second pair of legs, the other of the first pair of legs extending toward and being connected with the other of the second pair of legs.

2. The tie-down of claim 1 wherein the bight of the first latch portion generally lies in a first reference plane and the bight of the second latch portion generally lies in a second reference plane.

3. The tie-down of claim 2 wherein the first and the second reference planes are generally perpendicular relative to one another.

4. The tie-down of claim 1 wherein each of the first and the second latch portion bights has a dimension of thickness, and wherein the second latch portion bight is thicker than the first latch portion bight.

5. The tie-down of claim 4 wherein the latch is connected with the catch so that the latch is oriented with one of the first and the second latch portions positioned toward the catch and the latch extending generally away from the catch to the other of the second and first the latch portions.

6. The tie-down of claim 4 further including an elongated member interposed between and interconnecting the latch and the catch.

7. The tie-down of claim 1 wherein each of the first and the second latch portion bights has a dimension of thickness, and wherein the second latch portion bight is thicker than the first latch portion bight.

8. The tie-down of claim 1 further including an elongated member interposed between connecting the latch and the catch.

9. A tie-down comprising:

a catch, the catch being adapted to releasably couple with a strike of a vehicle lock mechanism;

a latch connected with the catch, the latch having an annular body, the body having a first latch portion and a second latch port on, the first latch portion being generally U-shaped with a first bight and a first pair of legs, the first bight extending in a first direction from one of the first pair of legs to the other of the first pair of legs, the second latch portion being generally U-shaped with a second bight and a second pair of legs, the second bight extending in a second direction from one of the second pair of legs to the other of the second pair of legs, the first and the second directions being generally perpendicular relative to one another.

10. The tie-down of claim 9 wherein the bight of the first latch portion generally lies in a first reference plane and the bight of the second latch portion generally lies in a second reference plane.

11. The tie-down of claim 10 wherein the first and the second reference planes are generally perpendicular relative to one another.

12. The tie-down of claim 9 wherein each of the first and the second latch portion bights has a dimension of thickness, and wherein the second latch portion bight is thicker than the first latch portion bight.

13. The tie-down of claim 12 wherein the latch is connected with the catch so that the latch is oriented with one of the first and the second latch portions positioned toward the catch and the latch extending generally away from the catch to the other of the second and first the latch portions.

14. The tie-down of claim 12 further including an elongated member interposed between and interconnecting the latch and the catch.

15. The tie-down of claim 9 wherein each of the first and the second latch portion bights has a dimension of thickness, and wherein the second latch portion bight is thicker than the first latch portion bight.

16. The tie-down of claim 9 further including an elongated member interposed between and interconnecting the latch and the catch.

17. A tie-down, the tie-down having a first tie end and an opposing second tie end, comprising:

a catch, the catch being at the first tie end, the catch being adapted to releasably couple with a strike of a vehicle lock mechanism, and the catch having an aperture extending through the catch;

a latch connected with the catch, the latch being at the second tie end, the latch having an annular body, the latch including first latch portion, the first latch portion being generally U-shaped and having a first bight and a first pair of legs, whereby the latch is adapted to releasably couple with a catch of a vehicle lock without interfering with adjacent body structure of the vehicle, the first bight extending in a first direction from one of the first pair of legs to the other of the first pair of legs, the latch further including a second latch portion, the second latch portion being generally U-shaped with a second bight and a second pair of legs, the second bight extending in a second direction from one of the second pair of legs to the other of the second pair of legs, the first and the second directions being generally perpendicular relative to one another, a position of the latch being changeable relative to the catch between having the first latch portion at the second tie end and having the second latch portion at the second tie end.

18. The tie-down of claim 17 wherein each of the first and the second latch portion bights has a dimension of thickness, and wherein the second latch portion bight is thicker than the first latch portion bight.

* * * * *